United States Patent [19]

Murakami et al.

[11] 3,971,207

[45] July 27, 1976

[54] PACKING MEANS FOR A WATCH

[75] Inventors: Tomomi Murakami, Higashi Yamato; Hiromichi Nagata, Higashi Murayama; Masakazu Funazawa, Tokorozawa; Satoru Fukutome, Atsugi, all of Japan

[73] Assignee: Citizen Watch Co., Ltd., Tokyo, Japan

[22] Filed: May 19, 1975

[21] Appl. No.: 579,005

[30] Foreign Application Priority Data

May 21, 1974 Japan ..... 49-56860

[52] U.S. Cl. ..... 58/152 B; 58/23 BA; 58/57.5; 58/88 R

[51] Int. Cl.[2] ..... G04B 23/12; G04B 37/08; G04C 23/04

[58] Field of Search ..... 58/23 R, 23 BA, 57, 58/57.5, 88 R, 94, 23 A, 23 AC, 19 R, 152 R, 152 B

[56] References Cited

UNITED STATES PATENTS

| | | | |
|---|---|---|---|
| 2,913,869 | 11/1959 | Schlenker | 58/88 R |
| 3,018,614 | 1/1962 | Brien | 58/23 BA X |
| 3,025,662 | 3/1962 | Fleishman et al. | 58/23 BA X |
| 3,032,651 | 5/1962 | Gisiger-Stahli et al. | 58/23 BA X |
| 3,224,184 | 12/1965 | Brien | 58/23 R X |
| 3,670,491 | 6/1972 | Weschler | 58/23 BA |
| 3,729,923 | 5/1973 | Brigliano et al. | 58/23 BA X |
| 3,905,666 | 9/1975 | Grimm et al. | 58/23 R X |

FOREIGN PATENTS OR APPLICATIONS

| | | | |
|---|---|---|---|
| 1,075,505 | 2/1960 | Germany | 58/23 BA |
| 1,075,506 | 2/1960 | Germany | 58/23 BA |
| 1,094,667 | 12/1960 | Germany | 58/23 BA |
| 343,327 | 1/1960 | Switzerland | 58/23 BA |
| 370,016 | 7/1963 | Switzerland | 58/23 BA |
| 377,736 | 6/1964 | Switzerland | 58/23 BA |

*Primary Examiner*—L. T. Hix
*Assistant Examiner*—Stanley J. Witkowski
*Attorney, Agent, or Firm*—Spensley, Horn & Lubitz

[57] ABSTRACT

A packing means for waterproofing a watch case having a non-conductive, flexible ring portion and a conductive yet flexible arm member is disclosed. The packing device is disposed in a watch case and allows for an electrical connection to be made between the watch and an external device. The ring member is made of a resilient, non-conductive, flexible material and is disposed in the watch case so as to be sandwiched between the top and bottom members thereof. At least one arm member also made of a resilient flexible material having first and second ends is coupled to the ring and extends into the center thereof. However, the arm member is conductive and electrically couples the watch (the internal components) with the external device. The arm member is coupled to the ring member such that the substantially watertight seal in the watch case is not destroyed. By the use of the instant packing means of the present invention, a substantially waterproof seal in the watch case is achieved while permitting an external device to be electrically and flexibly coupled to the watch without destruction of the waterproof seal.

19 Claims, 9 Drawing Figures

Fig. 8
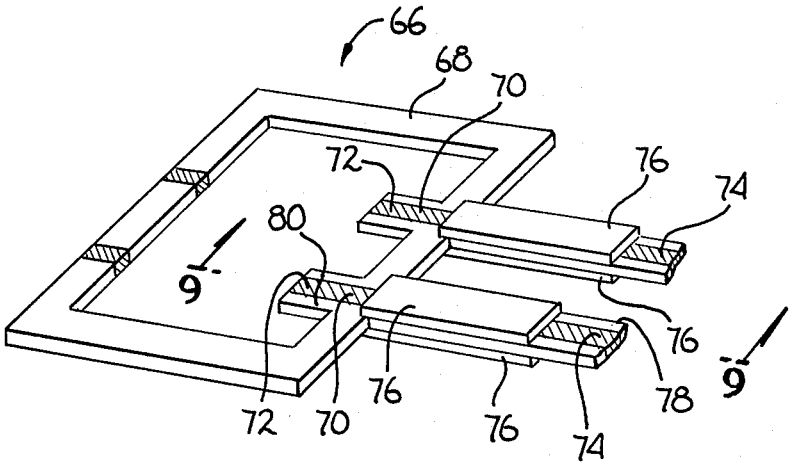
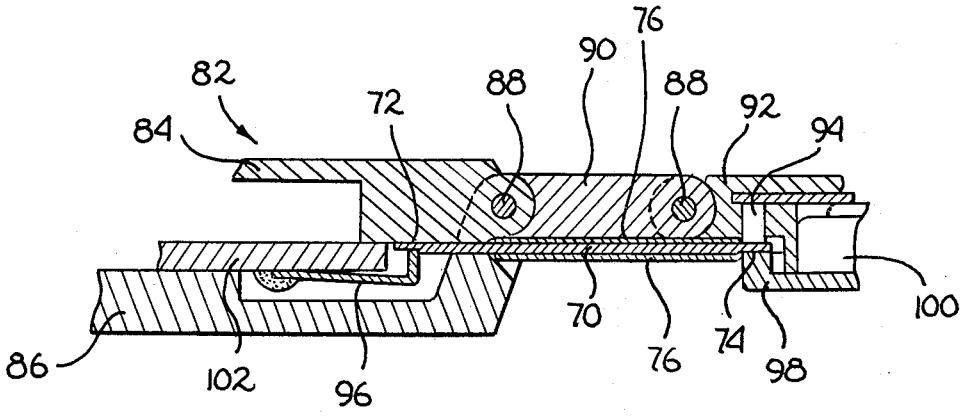
Fig. 9

PACKING MEANS FOR A WATCH

BACKGROUND OF THE INVENTION

1. Field of the Invention

The present invention relates to a packing means for waterproofing a timepiece whose movement is electrically coupled to an external device via the packing means.

2. Prior Art

Heretofore electrical connection between devices inside a watch case and those outside the case, e.g., supplying power from an external battery enclosed in an apparatus attached to a watch band to the movement within the case, or delivering electronic signals from within the case to an external alarm device, has been accomplished by metal wiring using many types of junction elements. However, waterproofing of those points on the case and the packing of an external apparatus where such wiring passes through is difficult and complete watertightness of such areas is extremely difficult to achieve. Moreover, in those rare instances where such watertightness is achieved, the flexibility of the means used to join the watch case with the external device is extremely diminished. Further, such prior art waterproofing means are extremely bulky and render the timepiece aesthetically unappealing.

Installation of junction elements and electrical wiring also requires additional procedures such as soldering, screwing and the like whereby complicated assembling and disassembling operations are necessary. Manufacture of a more compact watch is thereby made difficult and in addition, where the case and watch band are flexibly connected, there is a tendency for the electrical wires to break or otherwise become disconnected because of the bending and rotating action.

There has been a long-felt need for a means which would enable an external device to be electrically coupled to a watch. This has evolved because of the fact that the area inside the watch is extremely limited and many times the device which is to be coupled to the watch would take up so much area inside the case as to render the watch extremely large and bulky.

In response to this problem, the prior art has proposed to place some of the components outside of the watch case and then electrically couple the external components to the watch. This has the advantage of permitting the watch to be made relatively small and thin, and aesthetically pleasing, and yet enables added features to be coupled thereto for their specific functions. Moreover, such a system also permits the external device to be selectively altered, repaired or replaced without requiring entry into the watch.

The difficulty with such system is that it is extremely desirable and even necessary in some instances to provide the watch case with a seal whereby the internal components thereof are prevented from being contacted by water and moisture and the like by entry into the watch case. However, under prior art systems in which such waterproofing qualities were achieved, it was extremely difficult for an external device to be coupled to the watch case without completely destroying the waterproofing seal. One prior art system to overcome the aforementioned problem was to completely wrap the wires used to connect the external device with the watch in rubber or other non-conductive and watertight material. However, this type of connector is likely to be extremely bulky as mentioned hereinabove. Moreover, such a system does not take into account the number of times the connector is flexed. Thus, damages to the connector in such a system are more likely.

The present invention represents an advancement in the art of packing means and means used for connecting an external device with the internal workings of a watch and contains none of the aforementioned shortcomings associated with the prior art. The present invention thus provides an apparatus wherein a substantially watertight seal in a watch case is achieved but which also provides a flexible yet conductive means to extend outside the watch case and be electrically coupled to an external device.

BRIEF SUMMARY OF THE INVENTION

The present invention relates to a packing means disposed in watch cases which allows an electrical connection to be made between the watch and an external device while providing a substantially watertight seal in said watch. The packing means comprises a first ring member made of a resilient, non-conductive material disposed in the watch case so as to be sandwiched between top and bottom members thereof and providing a substantially watertight seal between the top and bottom members. Coupled to the nonconductive ring member is at least one conductive arm member made of a resilient flexible material having first and second ends. The conductive arm member represents a unique aspect and a point of novelty of the instant invention. Because the arm member is resilient and flexible yet also conductive, it may be coupled to the ring member in the watch without destroying the waterproof seal therein. The arm member has first and second ends with the first end being coupled to the ring member so as to make electrical connection within the watch, and the second end extends outwardly therefrom and is coupled to the external device.

The arm member may be disposed along a watch band with the external device mounted thereto. Because the arm member is made of a flexible material, the flexing of the watch band does not destroy the electrical connection made between the external device and the watch case. Thus, the means used to connect the external device and the watch case of the instant invention virtually eliminates the problem of the prior art as discussed hereinabove.

The novel features which are believed to be characteristic of the invention, both as to its organization and method of operation, together with the further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 8 is a perspective view of the packing means according to another embodiment of the present invention in which the arm members are totally encased in a non-conductive flexible material.

FIG. 9 is a cross-section taken along lines 9—9′ of FIG. 8 showing the packing means used to form the electrical path between the watch case and the external device.

DETAILED DESCRIPTION OF THE INVENTION

Figure 1:
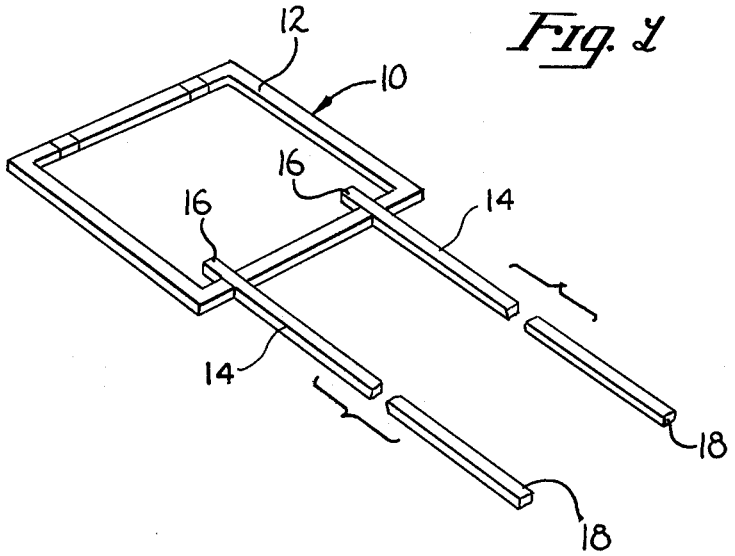
FIG. 1 is a perspective view of a packing means according to one embodiment of the present invention.

Referring first to FIG. 1, the packing means of the present invention is clearly shown. Packing means 10 comprises a generally square, rectangular or circular waterproofing ring 12. Other shapes are also within the scope of this invention, the specific shape depending upon the shape of the watch case. At least one electrically conductive arm 14 is arranged and configured such that the arm preferably crosses a portion of the ring 12 forming an integral part thereof. Each conductive arm 14 has first end 16 and second end 18. First end 16 generally extends inwardly a short predetermined distance into the ring 12 toward the center thereof and the second end 18 extends outwardly therefrom in the opposite direction a predetermined distance from the ring, and is electrically coupled to an external device as hereinafter discussed.

Waterproofing ring 12 is made of a resilient, nonconductive flexible material such as, for example, rubber, and more specifically, silicon rubber and the like. Conductive arm 14, including the portion which crosses the ring 12, is also made of a resilient, flexible material such as, for example, silicon rubber and the like. However, in order to make arm 14 conductive, the silicon rubber is mixed with a conductive material such as, for example, carbon particles, metal particles and the like. The arm members 14 represent a distinct improvement over the prior art and a point of novelty of the instant invention. Because the arm members 14 are conductive along the length thereof, they are able to form an electrical pathway from the ring member extending outwardly therefrom to an external device. They are also sufficiently flexible so as to not destroy the waterproof seal in the watch case.

Figure 2:
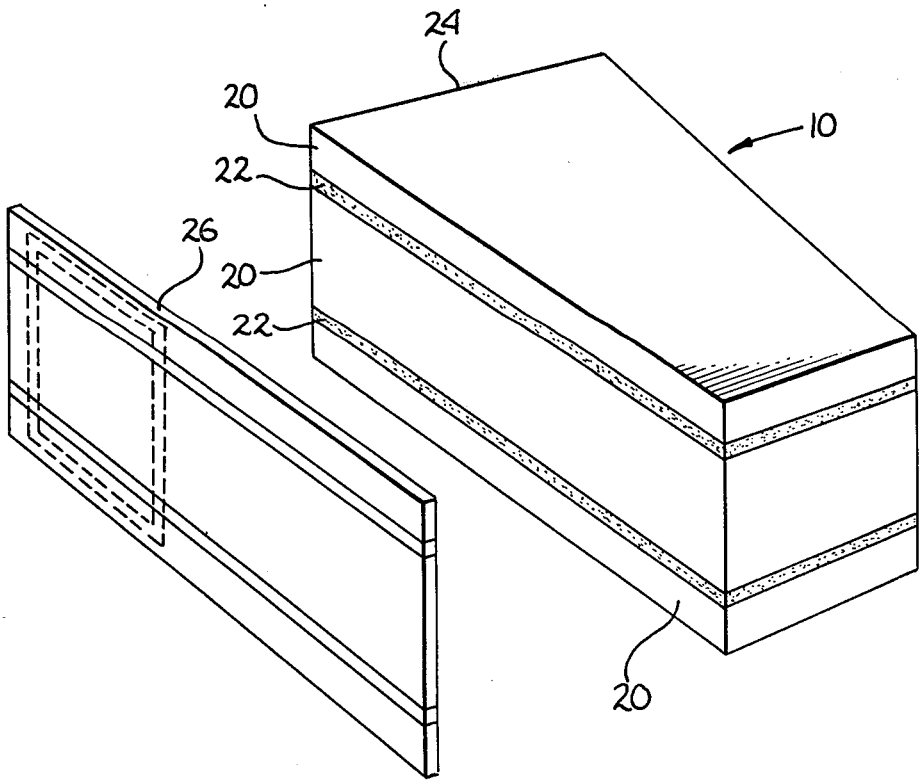
FIG. 2 is a perspective view of the block from which the packing of FIG. 1 is fabricated.

As shown in FIG. 2, packing means 10 is fabricated by alternately piling non-conductive rubber layers 20 and thin conductive rubber layers 22 to form a rubber block 24. The rubber block 24 is then sliced cross-sectionally an appropriate thickness into a rubber sheet 26. Finally, the rubber sheet 26 is cut out into the desired shape (shown by broken lines) and forms the desired packing structure 10 as illustrated in FIG. 1. It should be noted that a specific shape of the ring member 12, the arm members 14, and the amount of excess rubber layer 22 which may be disposed on either side of the arm members 14 is a matter of choice and will be governed by the specific configurations desired.

Figure 3:
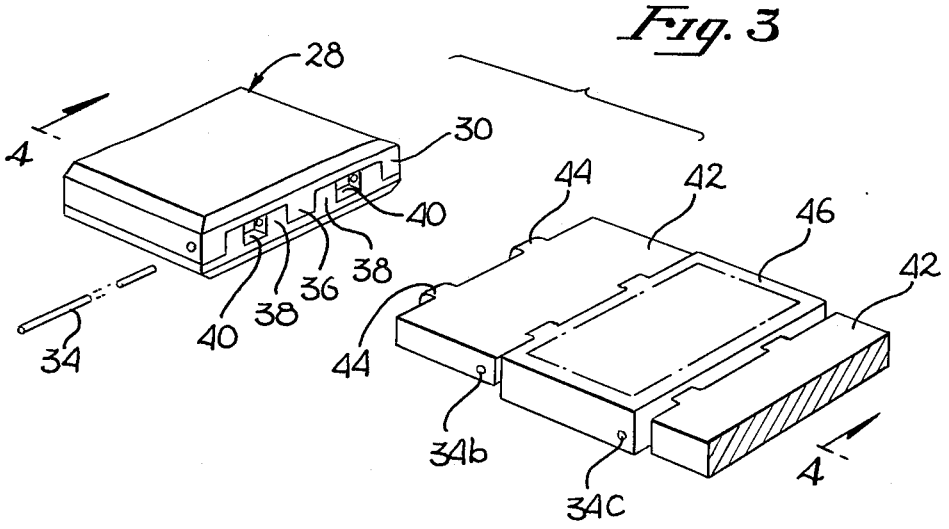
FIG. 3 is a perspective view of a watch case with a portion of watch band having an external device as a part thereof.

Referring now to FIG. 3, one can see how the packing 10 is disposed in a typical watch case. The watch case 28 in the presently preferred embodiment is constructed such that a plastic case top or upper case 30 and a back or bottom cover 32 tightly sandwich the ring member 12 within the case 28. This ring 12 thus provides for a substantially watertight seal between the upper case 30 and bottom cover 32. Upper case 30 has a plurality of comb-like teeth 36 projecting downward which form grooved openings and engage a plurality of corresponding teeth 38 extending upward from bottom cover 32. A number of teeth 36 and 38 are removed to form recesses 40. In the presently preferred embodiment, two such recesses are formed. Into recesses 40, projections 44 provided on the side of a typical plastic watch band 42 are inserted. The watch band 42 and the watch case 28 are rotatably secured together by a rotatable pin member 34 skewered through an associated hole in the watch case 28. Similar pin members 34*b* and 34*c* and associated teeth and recesses are also used to attach the watch band 42 to the external device container 46. Of course it is understood that other means for rotatably coupling the watch band to the watch case and the device to the watch band are within the scope of this invention. By the use of the aforementioned configuration, watch band 42 is thus flexibly and rotatably attached to the case 28.

Referring again to FIG. 3, one can see that the external device container 46 has a generally rectangular configuration and is adapted to receive a battery, alarm or other devices therein and is disposed so as to be part of the watch band 42. Other configurations for the device container 46 and means used to couple it to the watch case 28 and/or the associated band are also within the scope of this invention.

Figure 4:
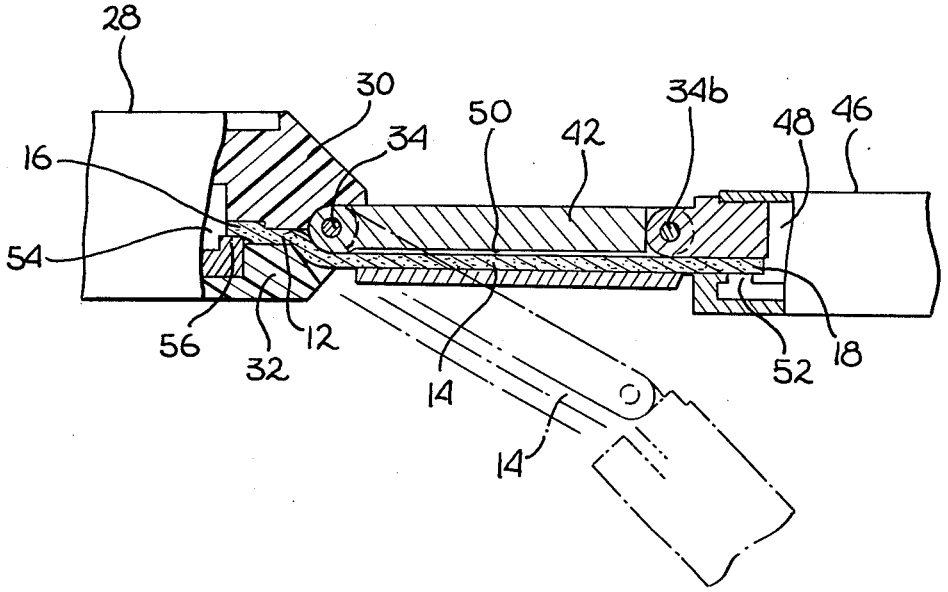
FIG. 4 is a cross-section taken along lines 4—4′ of FIG. 3 showing the packing means, and more specifically, the flexible arm member used to form the electrical path.

In FIG. 4, one can see a cross-section of the watch case 28 showing the packing means and more specifically, the arm members 14 used to form the electrical path between the watch case 28 and the external device container 46. The first end 16 of conductive arm 14 is connected to a terminal 56 in a watch movement 54 disposed within the watch case 28. Note that because end 16 is flexible, it is relatively easy to form an electrical contact therewith. This flexibility also retards possible damage, because of any flexing action of band 42. One can see that because the end 16 of arm 14 extends inward toward the center of the ring 12, the upper case 30 and the back cover 32 are generally coupled to each other with the ring member 12 disposed thereinbetween. This connection thus forms the desirable substantially watertight seal between the two aforementioned members. Of course other electrical connection means for connecting an internal member of the watch to end 16 are also within the scope of this invention. A path thus formed between the internal workings of the watch along arm 14 through the plastic watch band 42 along a pilot hole 50 disposed therein and is ultimately led into the device container 46. Pilot hole 50 enables the arm 14 to make the desired contact and prevents the arm 14 from being exposed to the atmosphere. Within device container 46, the second end 18 of the arm 14 is electrically coupled to terminal 52 of the desired device 48 such as, for example, the terminal of a battery, an alarm system, and the like. Thus, the movement 54 of the watch and various external devices 48 in the device container 46 are electrically coupled by means of conductive arm 14 and enable power, signals and the like to be relayed thereinbetween.

When the angle of the watch band 42 changes (as shown by broken lines in FIG. 4), the first end 16 of the conductive arm 14 is subjected to bending and/or tension forces. However, because of the resiliency of the material of which the conductive arm 14 is made, namely, silicon rubber, first end 16 and second end 18 are able to cope with such movements. Moreover, because of the specific flexible material used, namely rubber, the arm member 14 does not limit the movement of the watch band 42.

As hereinabove discussed, the device container 46 may also be rotatably coupled to the watch band 42 with pin 34*b* such that it too may be flexible so as to insure the user a proper fit on the wrist, or to enable the device container to be rotated for viewing purposes and the like. Again, the property of the arm 14 makes this possible.

In the presently preferred embodiment of the invention, the case top 30, bottom cover 32, watch band 42 and device container 46 are preferably made of plastic material which is non-conductive and which provides the internal workings with necessary electrical insulation. However, they may also be made of conductive material such as, for example, metal. Under these conditions, it is necessary to provide insulation for the surface of each of the aforementioned elements when such element comes in contact with conductive arm 14. However, it should be noted that should the watch be configured such that there are metal parts used to couple the external device container 46 with the internal workings of the watch 54, only one conductive arm is necessary in order to complete the circuit. Thus, only the conductive arm need be insulated.

In a structure such as the one described in the presently preferred embodiment where conductive arm 14 is led through a pilot hole 50 inside watch band 42 to a device container, it is necessary to make the arm 14 as thin as possible in order to fit inside the pilot hole 50. As a result, the waterproofing ring 12 generally must be made relatively thin. This may have an adverse effect on the ability of the arm 14 to achieve the desired watertightness in the watch cover.

Figure 5:
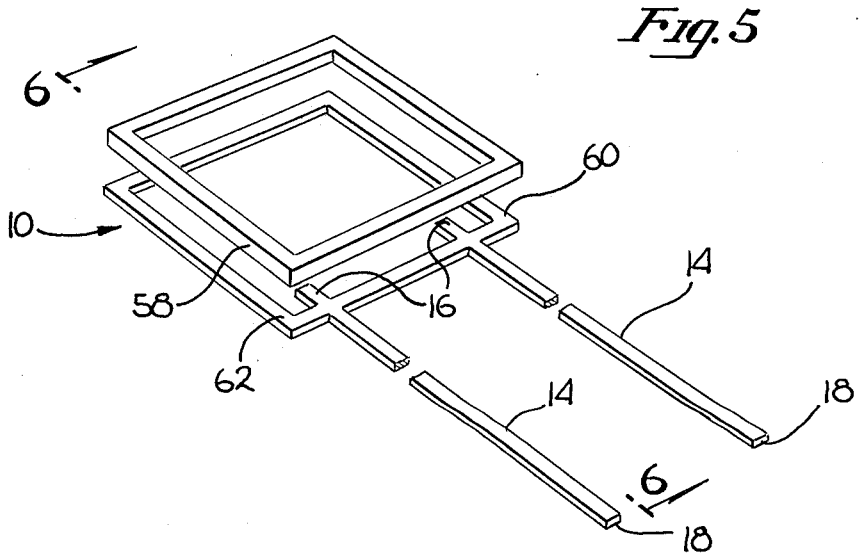
FIG. 5 is a perspective view of the packing having an additional ring member disposed thereabove.
Figure 6:
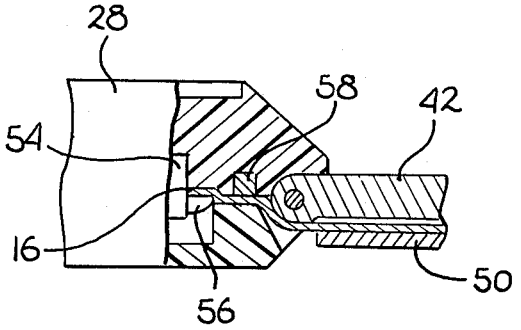
FIG. 6 is a cross-section of a typical watch case and a portion of a band, using the packing means and extra ring member of FIG. 5.

In order to prevent such drawback and to improve the watertight features of the present invention, it is also within the scope of this invention to provide a separate and additional ring 58 of a greater thickness than ring 12. The separate ring 58 does not have arm members as does ring 12 and may be pressed onto one or both sides of ring 12 as illustrated in FIG. 5. In FIG. 6, such second ring 58 is shown as sandwiching the arm member 14 and the ring 12 against the bottom cover 32. This helps insure that water, moisture and the like do not enter the watch case 28 from the exterior thereof. In the presently preferred embodiment, ring 58 is approximately twice as thick as ring 12.

Figure 7:
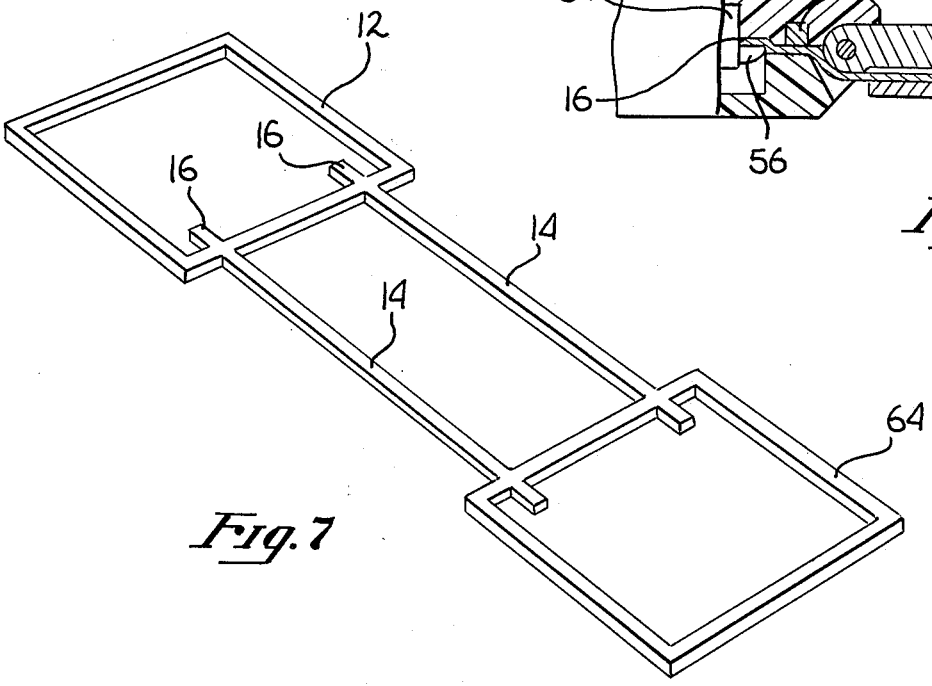
FIG. 7 is a packing having two rings one ring to be disposed in said watch case and the other ring to be disposed in an external device.

The packing 10, more specifically, the ring 12, may be used for either the watch case alone or the device container alone or for both. Such a latter configuration is shown in FIG. 7. In this embodiment, the first ring 12 is disposed at the first end 16 of conductive arm 14 and a second ring 64 is disposed at the second end 18 of the arms 14. In this configuration, the watertight advantages associated with the ring 12 are obtained in the external device container 46.

As described hereinabove, the packing of the presently preferred embodiment, comprising the non-conductive ring 12 and the conductive arm 14 forming an integral unit, has the advantages of (i) insuring the watertightness of the watch case; (ii) eliminating the possibility of the corrosion of the parts in the watch case; (iii) flexibility of the joint between the watch case and the external device or the watch band; and (iv) stable electrical connection between the watch case and the external device. Moreover, since there are no seams or junctions, additional steps such as soldering, screwing and the like are eliminated, thereby facilitating assembly and disassembly, changing of the external device, etc. This substantially reduces the cost of construction of the present device and is a definite improvement over similar means for coupling an external device to a watch case used by the prior art.

Referring now to FIG. 8, another embodiment of the packing of the present invention is shown. As in the first embodiment, the packing means 66 comprises a generally square, rectangular or circular waterproofing ring 68 and at least one electrically conductive arm 70 having a first end 72 and a second end 74. The arm 70 and the waterproofing ring 68 are made of the same material hereinabove described for conductive arm 14 and ring 12. The first end 72 of arm 70 extends inwardly a short predetermined distance from the ring 68 toward the center thereof, and the second end 74 extends outwardly therefrom a predetermined distance from the ring so as to be adapted to be coupled to an external device. Conductive arm 70 is fabricated such that the arm crosses a portion of the ring 68 forming an integral part thereof and is manufactured as hereinabove discussed with reference to FIG. 2. However, in this embodiment, when the packing is cut from the rubber block 24, excess non-conductive rubber is left on each side of the conductive arm 70 along the length thereof.

The novel features of this embodiment are that an additional electrically insulating member 76 is arranged and configured on the lower and upper surfaces of each conductive arm 70 along the length thereof. In addition to the electrical insulating member 76, the conductive arm 70 is insulated on each side along the length thereof by insulating members 78 and 80 also made of a resilient electrically insulative material such as, for example, silicon rubber. Insulating members 78 and 80 are fabricated from the rubber block hereinabove described, and horizontally sandwich the conductive arm thereinbetween. Insulating member 76 may also be formed by coating a resilient insulating material on the upper and lower surfaces of the arm 70 thereby forming an integral unit with the packing means 66. Generally, insulating member 76 extends along the length of the arm 70 and into the watch case and external device but does not cover the ends of the arm 70. By the use of this configuration, there is no exposed surface of the conductive arm member 70 which might make undesirable electrical connection with any of the other components in the watch case or in the external device.

FIG. 9 is a cross-sectional view of the device using the insulation means shown in FIG. 8 and showing the packing means 66 used to form the electrical path between the watch case 82 and the external device container 92. The device container 92 has a back or bottom cover 98 which has, in the presently preferred embodiment, a battery 100 disposed thereon. Of course it is within the scope of this invention to include other members within the device container 92. A positive pole terminal 94 is disposed in the device container 92 so as to form an integral part thereof and is electrically coupled to battery 100. Second end 74 of the conductive arm 70 is pressed against terminal 94 thereby establishing electrical contact with the battery 100.

A circuit substrate 102 for an electronic circuit is disposed in the watch case 82 and has a metal terminal 96 soldered or otherwise electrically attached thereto. The metal terminal 96 is yieldably pressed against the first end 72 of the conductive arm 70 and forms an electrical contact thereinbetween. Thus, there is an electrical path formed between the circuit substrate 102 and the battery 100 disposed in the external device container 92. Because the packing means 66 of the second embodiment has each of the conductive arms 70 completely surrounded by nonconductive, but flexible members, the conductive portions are well protected and remain watertight thereby further decreasing the susceptibility of shorting out because of moisture and the like entering into either the external device container 92 or the watch case 82. The exterior insulation about arm 70 means that no pilot hole in the band 90 is necessary and that the band 90 can be made of metal. In this embodiment, arm 70 is not disposed in a pilot hole as members 76 extend along the length thereof on the upper and lower surfaces of the arm 70. In this embodiment, watch case 82 is comprised of upper watch cover 84 and back or bottom cover 86 both of which are made of plastic. Case 82 is rotatably coupled to the band 90 by rotatable pin 88. A similar pin is also used to join the device container 92 to the band 90.

Although this invention has been disclosed and described with respect to particular embodiments, the principles involved are susceptible of other applications which will be apparent to persons skilled in the art. This invention, therefore, is not intended to be limited to the particular embodiments herein disclosed.

We claim:

1. A packing means disposed in a watch for allowing an electrical connection to be made between said watch and an external device and for providing a substantially watertight seal in said watch, said packing means comprising:

a first ring member made of a resilient, non-conductive flexible material, said ring member disposed in said watch so as to provide a substantially watertight seal therein; and at least one arm member made of a resilient, conductive flexible material having first and second ends, said first end coupled to said ring member within said watch, and said second end extending outwardly therefrom and coupled to said external device so as to electrically couple said watch with said external device, said arm member coupled to said ring member such that said substantially watertight seal in said watch case is not destroyed.

2. The packing means as defined in claim 1 wherein each said conductive arm member is sandwiched between non-conductive material.

3. The packing means as defined in claim 1 wherein said resilient non-conductive material of said ring member is silicon rubber.

4. The packing means as defined in claim 1 wherein two arm members are coupled to said ring member.

5. The packing means as defined in claim 1 wherein each said arm member is made from resilient silicon rubber with a conductive material disposed therein.

6. The packing means as defined in claim 5 wherein said conductive material is carbon particles.

7. The packing means as defined in claim 1 wherein each said arm member extends across said ring member into the center thereof.

8. The packing means as defined in claim 1 wherein, in addition thereto, a second ring member of resilient, non-conductive material is disposed above said first ring member, said first ring member being sandwiched between said second ring member and the bottom of said watch.

9. The packing means as defined in claim 1 wherein a second ring member made of a resilient, non-conductive material is disposed at said second end of said conductive arm member.

10. The packing means as defined in claim 9 wherein said second ring member is disposed in said external device so as to form a substantially watertight seal therein.

11. The packing means as defined in claim 1 wherein each said arm member has a resilient non-conductive material disposed on each side along the length thereof.

12. The packing means as defined in claim 11 wherein each said arm member has a resilient non-conductive material disposed on the top and bottom along the length thereof so as to completely encase each said arm member therein.

13. The packing means as defined in claim 1 wherein said external device is coupled to said watch case by an attaching member, said attaching member having a channel therein through which said arm member extends.

14. The packing means as defined in claim 1 wherein said external device has a battery disposed therein, said battery electrically coupled to said watch by said packing means.

15. The packing means as defined in claim 1 wherein said external device has an alarm device disposed therein, said alarm device electrically coupled to said watch by said packing means.

16. The packing means as defined in claim 1 wherein said watch case has a flexible metal terminal disposed therein, said flexible metal terminal yieldably engaging said first end of said arm member thereby making an electrical contact therewith.

17. The packing means as defined in claim 1 wherein said external device is rotatably coupled to said watch case by at least one pin member.

18. The packing means as defined in claim 1 wherein said external device is disposed on a watch band, said watch band rotatably coupled to said watch case, said watch band forming a pathway for said arm member to electrically couple said watch case to said external device.

19. The packing means as defined in claim 1 wherein said watch has an upper case and a bottom cover, said ring member being sandwiched between said upper case and said bottom cover.

* * * * *